US006363591B1

(12) United States Patent
Bell et al.

(10) Patent No.: US 6,363,591 B1
(45) Date of Patent: Apr. 2, 2002

(54) SAFETY BELT BUCKLE

(75) Inventors: John Bell, Carlisle; Brian Jack, Eastriggs, both of (GB)

(73) Assignee: Breed Automotive Technology, Inc., Lakeland, FL (US)

( * ) Notice: Subject to any disclaimer, the term of this patent is extended or adjusted under 35 U.S.C. 154(b) by 0 days.

(21) Appl. No.: 09/463,768

(22) PCT Filed: Aug. 4, 1998

(86) PCT No.: PCT/GB98/02337

§ 371 Date: Jan. 31, 2000

§ 102(e) Date: Jan. 31, 2000

(87) PCT Pub. No.: WO99/07243

PCT Pub. Date: Feb. 18, 1999

(30) Foreign Application Priority Data

Aug. 4, 1997 (GB) ..... 9716462
Sep. 12, 1997 (GB) ..... 9719492

(51) Int. Cl.[7] ..... A44B 11/26
(52) U.S. Cl. ..... 24/633; 24/642
(58) Field of Search ..... 24/633, 640–642; 297/468

(56) References Cited

U.S. PATENT DOCUMENTS 5,029,369 A * 7/1991 Oberhardt et al.
5,054,171 A * 10/1991 Tanaka ..... 24/633
5,097,571 A * 3/1992 Fohl
5,133,115 A * 7/1992 Bock
5,159,732 A 11/1992 Burke
5,216,788 A * 6/1993 Bock
5,280,669 A * 1/1994 Nanbu et al.
5,309,611 A * 5/1994 Wier et al.
5,341,546 A 8/1994 Burke
5,369,855 A * 12/1994 Tokugawa
5,704,099 A * 1/1998 Cahill ..... 24/633

FOREIGN PATENT DOCUMENTS

EP 0485656 A1 * 5/1992
EP 0681792 A2 * 11/1995
WO WO-95-30347 A1 * 11/1995

* cited by examiner

*Primary Examiner*—James R. Brittain
(74) *Attorney, Agent, or Firm*—Markell Seitzman

(57) ABSTRACT

An improved safety belt buckle for use with a buckle end pretensioner. The buckle for a vehicle safety restraint belt comprises a latch (5) moveable between a tongue engaging position in which the buckle is fastened and a tongue disengaged position in which the buckle is open, a button (7) moveable in the direction of tongue insertion to lift the latch against the action of a biasing spring (9), into the disengaging position. A securing means (10) in the form of a slidable plate is mounted in the buckle frame and is moveable between a position in which it restrains a movement of the latch into the disengaging position and a position in which it does not restrain movement of the latch. The securing plate is biased to the unrestraining position by a leaf spring (12), the strength of which is chosen so as to be overcome during the deceleration phase of a pretensioner so that the securing plate (10) moves to the restraining position and prevents opening of the buckle but so that when pretensioning forces dissipate, the securing plate moves back to the unrestraining position. In this buckle, the securing plate moves into the latch restraining position during the deceleration phase of the pretensioning operation and thus reduces the danger of the buckle jamming.

9 Claims, 3 Drawing Sheets

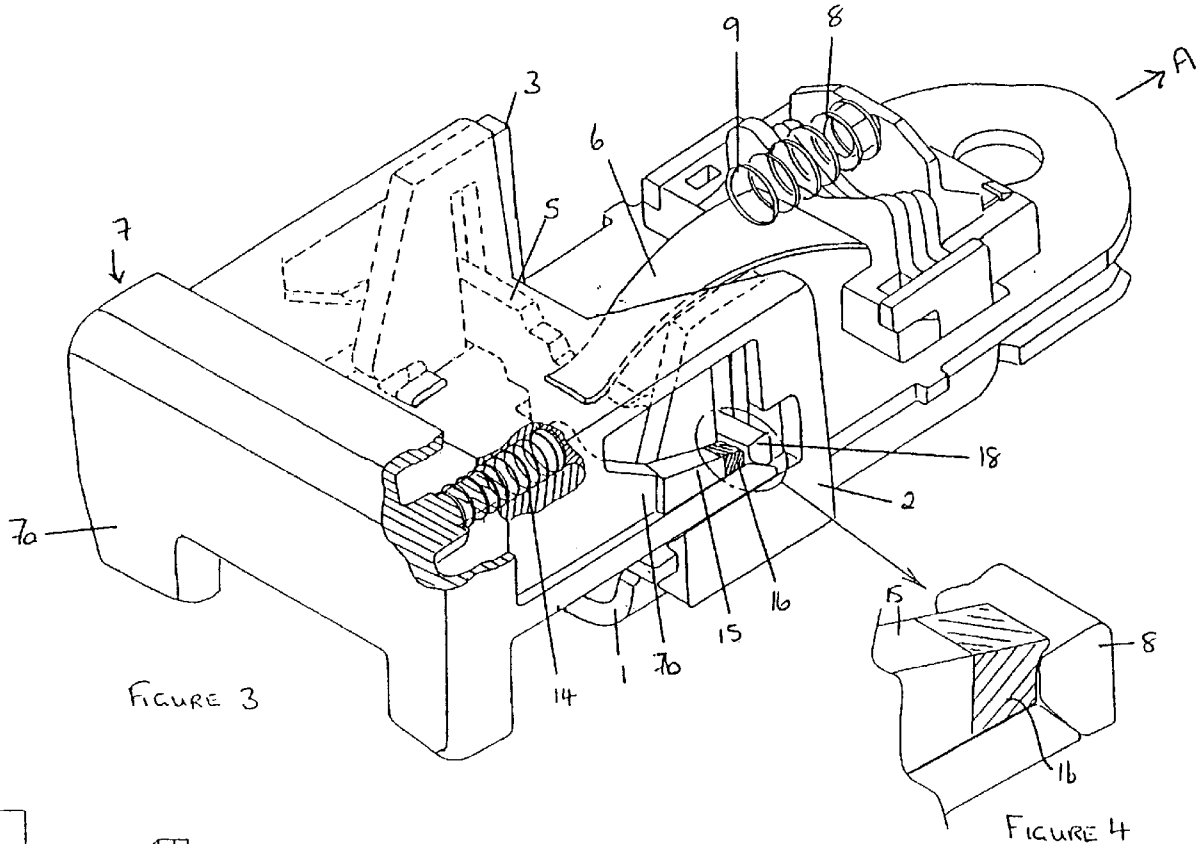
FIGURE 3
FIGURE 4
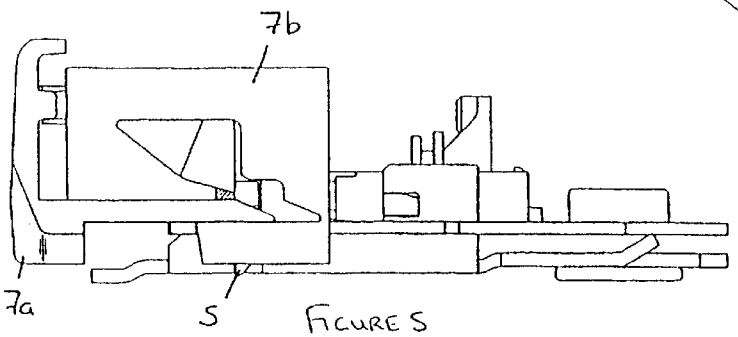
FIGURE 5

SAFETY BELT BUCKLE

The present invention relates to a safety belt buckle and particularly to a buckle for use with a buckle end pretensioner.

Pretensioners are used to rapidly pull back the buckle mounting so as to rapidly take up any slack in the seat belt holding the vehicle occupant in position. Slack can arise if the occupant is out of position (for example asleep!) or from lose windings on the retractor (so called spool film effect). The buckle is pulled back very quickly and thus extremely high G-forces are exerted on the buckle parts. A conventional buckle tends to unlatch under the influence of these high G-forces because of relative motion between parts of the buckle due to their different inertias. For example some parts may lag behind the buckle frame during the accelerating phase of the pretensioning operation. Other parts keep moving after the frame of the buckle has been stopped (this is deceleration phase of the pretensioning operation). In particular, during the deceleration phase the actuating button of the buckle keep moving and acts in the same way as if was being depressed, to open the buckle. Obviously this is highly undesirable and it is an object to the present invention to provide a buckle which is immune to the high G-forces generated during pretensioning.

One known pretensioner proof buckle is disclosed in EP 681 792. Here a pin type catch is loaded by a compression spring to a retracted position during normal operation of the buckle. However under pretensioning the retraction force of the spring is overcome by the high G-forces during the acceleration phase and the pin is moved into a blocking position over the buckle latch. At the end of the pretensioning stroke, i.e. during the deceleration phase the button tries to move into a de-latching position and the force exerted by the button on the latch jams the pin in its blocking position. Thus theoretically the buckle does not open.

However this mechanism relies on carts of the buckle jamming together and this sometimes locks up the buckle totally so that it cannot be released after the pretensioning operation is complete. This is obviously highly undesirable since in that case the vehicle occupant cannot be released from the seat.

It is an object of the present invention to provide an improved pretensioner proof buckle which does not jam on use.

According to the present invention there is provided a buckle for a vehicle safety restraint belt comprising a latch moveable between a tongue encasing position in which the buckle is fastened and a tongue disengaged position in which the buckle is open, a button moveable in the direction of tongue insertion to lift the latch against the action of a biasing spring, into the disengaging position, a securing means mounted in the frame of the buckle to be moveable between a position in which it restrains a movement of the latch into the disengaging position and a position in which it does not restrain movement of the latch, the securing means being biased to the unrestraining position by resilient means, the strength of the resilient means being such as to be overcome during the deceleration phase of a pretensioner so that the securing means moves to the restraining position and prevents opening of the buckle and when pretensioning forces dissipate, the securing means moves back to the un-restraining position.

Preferably the biasing means is a leaf spring held at its ends in slots in the buckle frame and its centre in a slot or by a hook mounted on the securing means. The securing means is preferably a slidable plate mounted for a sliding movement in slots in the frame. The latch is preferably biased to the tongue engaging position by a leaf spring.

A buckle constructed according to the present invention has significant advantages over the prior art because the securing means moves into the latch restraining position during the deceleration phase of the pretensioning operation and thus the danger of the buckle jamming is significantly reduced.

Of course a coil spring may be used instead of a leaf spring to bias the securing means.

In the preferred embodiment in which the securing means is held in the frame c the buckle, this pretensioning overlocker is very strong and can withstand the extremely high loads that are applied to the button assembly under pretensioning. In one embodiment the securing means is made lighter than the button. The securing means moves faster than the button during the deceleration phase and blocks the latch before the button exerts opening forces on the latch. The ratio of the spring strength to the mass of the securing means controls this operation. Typically the securing means is only half the mass of the button and the spring is arranged so that the force needed to overcome the inertia of the button is a multiple, up to around nine times, the force needed to overcome the inertia of the securing means.

According to an alternative embodiment, the latch is allowed to travel a small distance under pretensioning conditions but is inhibited from lifting fully out of tongue engagement by a section in the lower frame by a spring loaded mass assembly behind the latch maintaining the position of the latch in normal conditions. When the arrangement is under load during pretensioning then the securing means is moved into position by a calibrated spring which is set so that blocking of the latch is achieved prior to the button moving.

According to yet another alternative embodiment the button is formed in two sections which move together under normal working conditions. However under pretensioning conditions the inner button is allowed to move prior to the outer button since it is made heavier and thus has higher inertia. The inner button has a small abutment which under pretensioning conditions fits over or clamps against the latch and prevents it from lifting and unlocking the buckle. Preferably this abutment comprises a composite material with a much higher friction coefficient than the normal material used for a button. The mass of the inner button and the value of the calibration spring counteract the forces apply by the outer button to try to lift the latch and disengage the buckle.

For a better understanding of the present invention and show how the same may be carried into effect reference will now be made to the accompanying drawings in which:

FIG. 1 is a part cut away perspective view of a buckle according to one embodiment of the present invention;

FIG. 2*a* is a part cut away perspective view of a buckle according to a second embodiment of the present invention and FIG. 2*b* is an enlarged view of part of FIG. 2*a;*

FIG. 3 is a part cut away perspective view of a third embodiment.

FIG. 4 is an enlarged view of part of FIG. 3 showing a modification.

FIG. 5 is a side cross-sectional view of the embodiment of FIG. 3.

Figure 1:
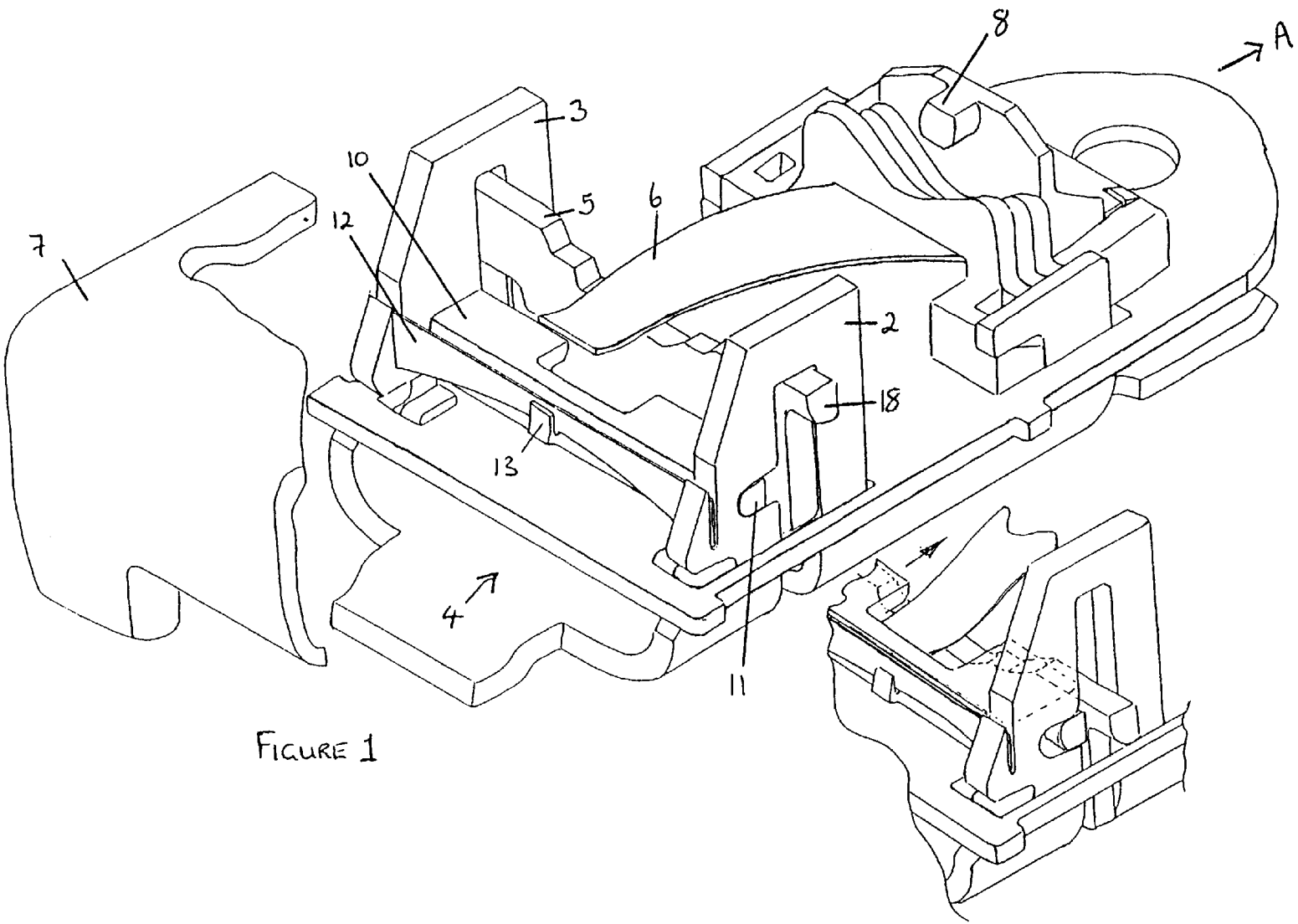

The buckle used in the present invention is a sliding latch buckle of generally known construction. The basic principles of this buckle are well known to those skilled in the art.

The buckle comprises a load bearing frame 1 of a generally U-shaped form with upstanding arms 2 and 3. A channel 4 for insertion of the buckle tongue is formed in a recess of the frame. A tongue engaging latch 5 is mounted in slots in the arms 2 and 3 of the frame and can slide up and down in these slots so as to engage the tongue in the lower position and disengage the tongue in its upper position. It is biased to the lower tongue engaging position by a leaf spring i and is lifted up against this bias by ramps (not shown) on the outer sides of actuating button 7. The button ramps engage the outwardly extending shoulders 18 on the latch 5.

A return spring for the button 7 is mounted on boss 8 at the back of the frame 1. The spring itself is not shown in FIG. 1 but is shown in FIG. 3 with reference 9.

The buckle is made pretensioner proof by a sliding securing means 10. The securing means takes the form of a sliding plate engaging generally horizontal slots 11 in the upstanding arms 2 and 3 of frame 1. This securing plate is biased to the position shown in FIG. 1 by a leaf spring 12 which is secured at its ends in the upstanding arms 2 and 3 of frame 1 and at its centre by a hook 13 on sliding plate 10. In this position the latch 5 is free to move up and down into and out of a tongue engaging position and thus normal operation of the buckle is unchanged by the addition of this plate 10.

However under pretensioning conditions the buckle mounting is pulled rapidly in the direction A during the acceleration phase of pretensioning the button 7, as also the plate 10, have a potential to lag behind the frame 1. In practice there is no actual movement since the button 7 is prevented from relative motion outwardly of the frame by stops on the frame (not shown). The plate 10 is prevented from relative rearward movement by the end surface in horizontal slots 11 in the frame 1.

At the end of the acceleration phase, the frame is stopped from motioning direction A abruptly. However the inertia of the button and of the plate 10 cause them to continue moving in direction A. The ratio of the spring force to the mass of the plate 10, compared to the mass or the button 7, allows the plate 10 to overcome the bias of the spring 12 and to move, relative to the frame 1, in direction A. This puts it in a position sitting over the latch 5 and preventing the latch from lifting. The button 7 also tries to move in the direction A and the ramps on the button exert an upward force on the lugs 8 of the latch 5. The latch 5 is prevented from moving upwards by the plate 10 and thus the buckle remains closed. By way of example, the button mass would typically be 7 grams, the plate 3 gms. Hence the force to react against the button is 5.6N and that for the plate is 0.6N. The ratio is 9:1 but other ratios would work.

When the pretensioning forces have dissipated, the spring 12 returns the plate 10 to its uninhibiting position (as shown in FIG. 1) and the buckle can be operated as normal.

Figures 2A, 2B:
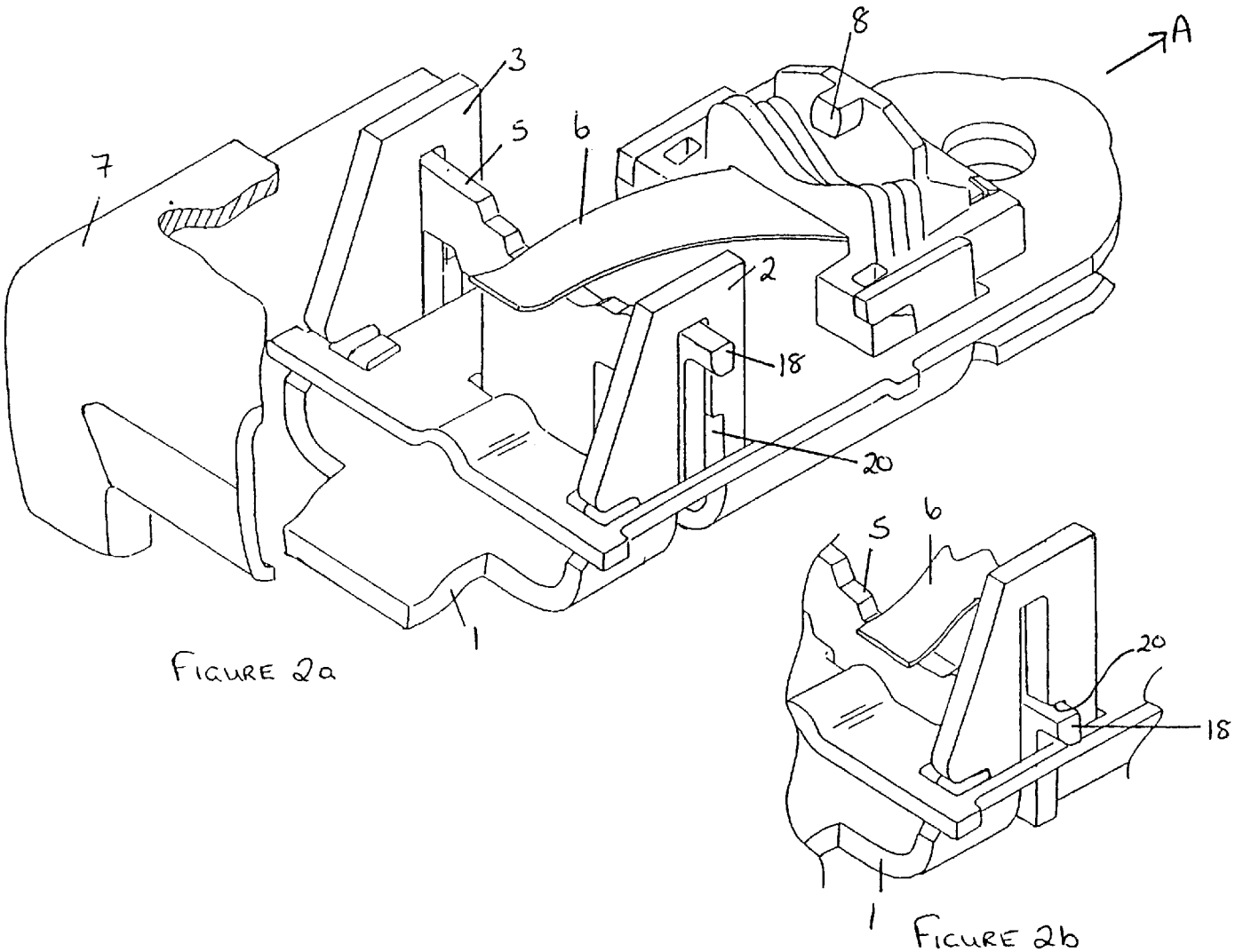

FIGS. 2*a* and *b* shows an embodiment in which extra cut outs 20 are formed on the upstanding arms 2 and 3 of the load bearing frame 1. Under pretensioning conditions the latch 5 moves in the direction A relative to the frame 1 and the outwardly extending shoulders 18 of the latch 5 engage into these cut outs 20 as shown more clearly in FIG. 2*b*. This prevents the latch from lifting out of engagement with the tongue.

FIG. 3 shows another alternative embodiment. Like parts are denoted by like reference numerals. In this case the button 7 is formed of two parts. A front, outer part 7*a* provides the surface on which a manual actuation of the button is made, i.e. on which the user presses. Rear or inner part 7*b* is connected to part 7*a* by a calibration spring 14.

Under normal operation the outer 7*a* End inner part 7*b* of the button 7 move together and ramps 15 engage the outwardly extending arms 18 of the latch 5 to lift the latch against the bias of the leaf spring 6.

Under pretensioning conditions, the inner button 7*b* moves slightly faster than the outer button 7*a* (since it is formed with a higher mass). This is during the deceleration phase of the pretensioning. Under these conditions the front portion 16 of ramps 15 abut the latch 5 in the region of arms 18. This portion 16 is preferably made of a material having a high coefficient friction, for example some type of composite material and thus the force of the inner button 7*b* pressing against the side of arms 18 of latch 5 is sufficient to retain the latch in the tongue engaging position and prevent the buckle from opening.

FIG. 4 shows a modification in which the portion 16 is shaped so as to have a slight overhang 17 to more securely restrain the arms 18 of the latch 5.

FIG. 5 is a cross-sectional view of the embodiment of FIG. 3 and like parts are denoted by like reference numbers.

What is claimed is:

1. A buckle for a vehicle safety restraint belt, comprising:

a latch moveable between a tongue engaging position in which the buckle is fastened and a tongue disengaged position in which the buckle is open;

a button moveable in the direction of tongue insertion to lift the latch into the disengaging position against the action of a biasing spring;

securing means mounted in a frame of the buckle and moveable between a position in which it restrains a movement of the latch into the disengaging position and a position in which it does not restrain movement of the latch, the securing means being biased to the unrestraining position by resilient means, the strength of the resilient means being such that biasing action is overcome during a deceleration phase of a pretensioner so that the securing means moves to the restraining position and prevents opening of the buckle, and when pretensioning forces dissipate, the biasing action takes effect again and the securing means moves back to the unrestraining position;

wherein the resilient means is a leaf spring held at its ends in slots in the buckle frame and held at its centre by means mounted on the securing means.

2. A buckle according to claim 1 wherein the means mounted on the securing means is a hook.

3. A buckle according to claim 1 wherein the latch is biased to the tongue engaging position by a leaf spring.

4. A buckle according to claim 1 wherein the securing means is lighter than the button.

5. A buckle according to claim 4 wherein the securing means has a mass which is approximately half the mass of the button.

6. A buckle according to claim 4 wherein the bias spring is arranged so that the force needed to overcome the inertia of the button is a multiple of the force needed to overcome the inertia of the securing means.

7. A buckle according to claim 6 wherein the bias spring is arranged so that the force needed to overcome the inertia of the button is up to around nine times the force needed to overcome the inertia of the securing means.

8. A buckle for a vehicle safety restraint belt, comprising:

a latch moveable between a tongue engaging position in which tile buckle is fastened and a tongue disengaged position in which the buckle is open;

a button moveable in the direction of tongue insertion to lift the latch into the disengaging position against the action of a biasing spring;

wherein the button is formed by an inner section and an outer section of a different mass, wherein the two sections move together under normal buckle working conditions, but, under pretensioning conditions, the inner button moves prior to the outer button;

wherein the inner section has a small abutment which, under pretensioning conditions, fits over or clamps against the latch and prevents it from lifting and unlocking the buckle;

wherein the abutment comprises a composite material with a high coefficient of friction.

9. A buckle according to claim 8 wherein the mass of the inner section and the strength of a calibration spring acting thereon are chosen to counteract the forces applied by the outer section that try to lift the latch to disengage the buckle.

* * * * *